US011317689B2

(12) United States Patent
He

(10) Patent No.: US 11,317,689 B2
(45) Date of Patent: May 3, 2022

(54) OUTDOOR UMBRELLA CAPABLE OF BEING FOLDED AND UNFOLDED BY PRESSING

(71) Applicant: Zhejiang Qinda Travelling Products Co., Ltd., Zhejiang (CN)

(72) Inventor: Daqin He, Zhejiang (CN)

(73) Assignee: Zhejiang Qinda Travelling Products Co., Ltd., Zhejiang (CN)

( * ) Notice: Subject to any disclaimer, the term of this patent is extended or adjusted under 35 U.S.C. 154(b) by 0 days.

(21) Appl. No.: 17/093,533

(22) Filed: Nov. 9, 2020

(65) Prior Publication Data

US 2022/0079307 A1 Mar. 17, 2022

(30) Foreign Application Priority Data

Sep. 14, 2020 (CN) ..... 202022006826.2

(51) Int. Cl.
*A45B 25/14* (2006.01)
*A45B 25/02* (2006.01)
*A45B 19/10* (2006.01)

(52) U.S. Cl.
CPC ..... *A45B 25/14* (2013.01); *A45B 19/10* (2013.01); *A45B 25/02* (2013.01)

(58) Field of Classification Search
CPC .... A45B 2023/0056; A45B 2023/0068; A45B 2023/0031; A45B 2023/0043; A45B 25/14; A45B 25/02; A63B 63/083
See application file for complete search history.

(56) References Cited

U.S. PATENT DOCUMENTS 5,465,957 A * 11/1995 Schroeder ..... A63B 63/083 248/286.1
6,401,735 B1 * 6/2002 Chou ..... A45B 23/00 135/20.1
6,694,993 B2 * 2/2004 Chou ..... A45B 23/00 135/98
6,725,870 B1 * 4/2004 Lo ..... A45B 23/00 135/20.1
2003/0140955 A1 * 7/2003 Chou ..... E04H 15/50 135/98

(Continued)

FOREIGN PATENT DOCUMENTS

CN 210299841 4/2020
EP 1042973 A1 * 10/2000 ..... A45B 25/16

*Primary Examiner* — Noah Chandler Hawk
(74) *Attorney, Agent, or Firm* — JCIP Global Inc.

(57) ABSTRACT

An outdoor umbrella includes an umbrella post, an umbrella cover assembly and a folding-unfolding device. The umbrella cover assembly includes an umbrella rib assembly and an umbrella fabric covering the umbrella rib assembly. The folding-unfolding device includes a slide sleeve, a folding-unfolding handle assembly and a pull rod. A first oblique rod and a second oblique rod hinged and matched with each other are disposed on the umbrella rib assembly. One end of the first oblique rod is hinged to the slide sleeve. One end of the second oblique rod is hinged and matched with the umbrella post. A middle portion of the folding-unfolding handle assembly is hinged and matched with the umbrella post, and the folding-unfolding handle assembly is able to vertically stretch the pull rod in cooperation with a lever and drives the slide sleeve to slide vertically to fold or unfold the umbrella cover assembly.

11 Claims, 4 Drawing Sheets

(56) References Cited

U.S. PATENT DOCUMENTS

| | | | | |
|---|---|---|---|---|
| 2006/0054285 | A1* | 3/2006 | Louis | A45B 19/00<br>160/53 |
| 2015/0075574 | A1* | 3/2015 | Ma | A45B 25/08<br>135/20.1 |

* cited by examiner

OUTDOOR UMBRELLA CAPABLE OF BEING FOLDED AND UNFOLDED BY PRESSING

CROSS-REFERENCE TO RELATED APPLICATION

This application claims the priority benefit of China application serial no. 202022006826.2, filed on Sep. 14, 2020. The entirety of the above-mentioned patent application is hereby incorporated by reference herein and made a part of this specification.

BACKGROUND

Technical Field

The invention relates to the technical field of outdoor umbrellas, in particular to an outdoor umbrella capable of being folded and unfolded by pressing.

Description of Related Art

Outdoor umbrellas, also referred to as sunshades, generally include, by shape, single-side umbrellas such as side-post umbrellas, roman umbrellas and banana umbrellas, as well as center-post umbrellas which are typically used together with outdoor tables.

The folding-unfolding structure of existing outdoor umbrellas folds the umbrella cover generally through the cooperation of an umbrella rope and a hand-crank case. For example, Chinese Utility Model Patent Publication No. CN210299841U discloses a suspension umbrella convenient to adjust, which includes a vertical rod, an oblique rod, an umbrella frame, an umbrella cover, a first hand-crank device and an angle adjusting device. The umbrella cover is disposed on the umbrella frame, one end of the oblique rod is movably connected to the vertical rod, and the other end of the oblique rod is fixedly connected to the umbrella frame. The first hand-crank device is disposed on the vertical rod and is used to drive the umbrella frame to be folded or unfolded. The angle adjusting device is disposed on the vertical rod, is used to adjust the angle of the umbrella frame and comprises a second hand-crank device and a second connecting rope. The second hand-crank device is disposed on the vertical rod, one end of the second connecting rope is connected to the second hand-crank device, and the other end of the second connecting rope penetrates through the vertical rod to be connected to the oblique rod. Generally, to fold or unfold the suspension umbrella, the hand-crank cases have to be moved, and the ropes have to be taken up. The internal installation structure is complicated, and the manufacturing cost is high.

SUMMARY

The objective of the invention is to provide an outdoor umbrella capable of being folded and unfolded by pressing. To solve the above-mentioned technical problems, a press folding-unfolding structure is adopted to allow an umbrella cover to be unfolded or folded easily, so that operation is easier, the structure is simpler, and the manufacturing cost is lower.

The technical solution adopted by the invention to solve the technical problems is as follows.

An outdoor umbrella capable is foldable and unfoldable by pressing. The outdoor umbrella comprises an umbrella post, an umbrella cover assembly and a folding-unfolding device. The umbrella cover assembly comprises an umbrella rib assembly and an umbrella fabric covering the umbrella rib assembly. The folding-unfolding device comprises a slide sleeve which vertically slidable along the umbrella post, a folding-unfolding handle assembly for folding and unfolding, and a pull rod hinged between the slide sleeve and the folding-unfolding handle assembly. A first oblique rod and a second oblique rod hinged and matched with each other are disposed on the umbrella rib assembly. One end of the first oblique rod is hinged to the slide sleeve, and one end of the second oblique rod is hinged and matched with the umbrella post. A middle portion of the folding-unfolding handle assembly is hinged and matched with the umbrella post, and the folding-unfolding handle assembly is able to vertically stretch the pull rod in cooperation with a lever and drives the slide sleeve to slide vertically to fold or unfold the umbrella cover assembly.

The umbrella rib assembly comprises an upper umbrella disc and a lower umbrella disc. The upper umbrella disc comprises a first umbrella rib hinge part and an upper hinge part. The lower umbrella disc comprises a second umbrella rib hinge part and a lower hinge part. The first umbrella rib hinge part has a size longer than that of the second umbrella rib hinge part. A plurality of first umbrella ribs are hinged to the first umbrella rib hinge part, and a plurality of second umbrella ribs are hinged to the second umbrella rib hinge part. The first umbrella ribs are longer than the second umbrella ribs. An end portion of each of the second umbrella ribs is hinged to one of the first umbrella ribs. Another end of the first oblique rod is hinged and matched with the upper hinge part, and another end of the second oblique rod is hinged and matched with the lower hinge part.

The upper hinge part is integrally connected and fixed to the first umbrella rib hinge part as one piece, and the lower hinge part is integrally connected and fixed to the second umbrella rib hinge part as one piece.

The second oblique rod comprises two oblique rod bodies which are arranged symmetrically and are spaced apart from each other, and the first oblique rod penetrates between the two oblique rod bodies and is hinged and matched with the two oblique rod bodies.

A mounting base is disposed at a top end of the umbrella post, an end portion of each of the two oblique rod bodies is hinged and matched with the mounting base, and the mounting base is fixed to the top end of the umbrella post.

The slide sleeve comprises a first hinge part and a second hinge part, the first hinge part is hinged and matched with an end portion of the first oblique rod, and the second hinge part is hinged and matched with an end portion of the pull rod.

The slide sleeve is disposed around the umbrella post, and a sliding cavity in sliding fit with the umbrella post is formed in the slide sleeve.

The umbrella post has a slide sleeve sliding section having an arc structure.

The folding-unfolding handle assembly comprises two press rods which are arranged symmetrically and are spaced apart from each other. The umbrella post penetrates between the two press rods and is hinged and matched with the two press rods, and an end portion of each of the two press rods is hinged and matched with the pull rod through a connecting shaft.

A press handle is connected to another end portion of each of the two press rods.

Compared with the prior art, the invention has the following outstanding advantages and effects. Through an optimized design, the slide sleeve can be made to slide along the umbrella post by pressing based on the lever principle, so as to fold or unfold the umbrella cover without the connection of an umbrella rope, so that operation is easier, the structure is simple, and the manufacturing cost is low.

The features of the invention can be clearly understood with reference to accompanying drawings of the invention and the following detailed description of preferred embodiments.

DESCRIPTION OF THE EMBODIMENTS

To make the technical means, creative features, purposes and effects of the invention better understood, the invention is further expounded below in conjunction with the specific drawings.

Figure 1:
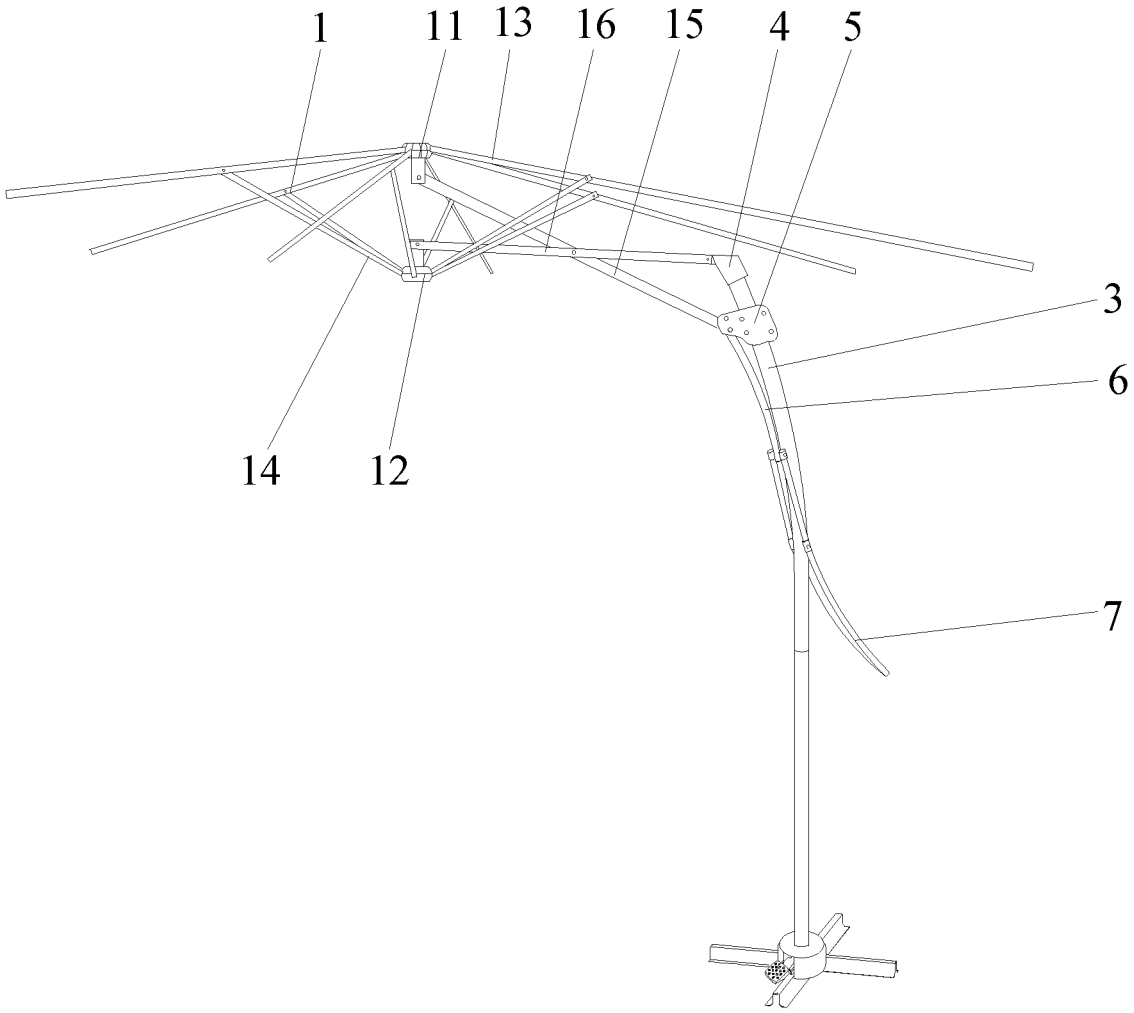
FIG. 1 is an overall assembled structural diagram of an umbrella rib assembly of the invention.
Figure 2:
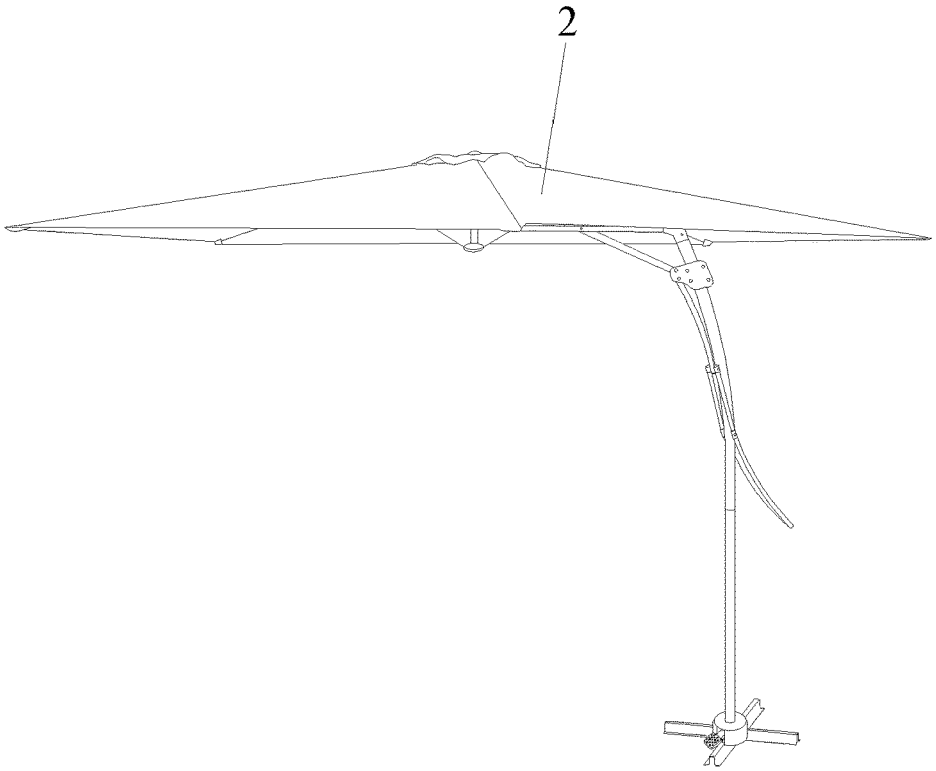
FIG. 2 is a structural diagram of an umbrella cover in an unfolded state of the invention.
Figure 3:
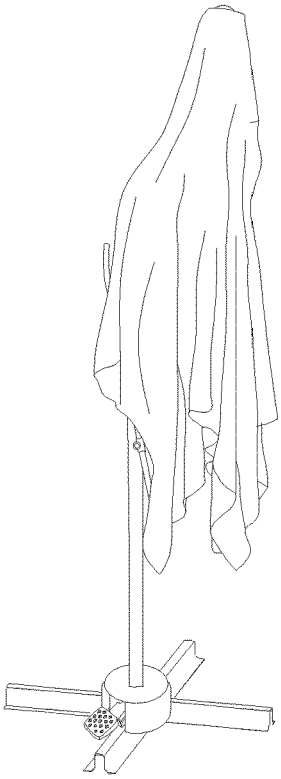
FIG. 3 is a structural diagram of the umbrella cover in a folded state of the invention.
Figure 4:
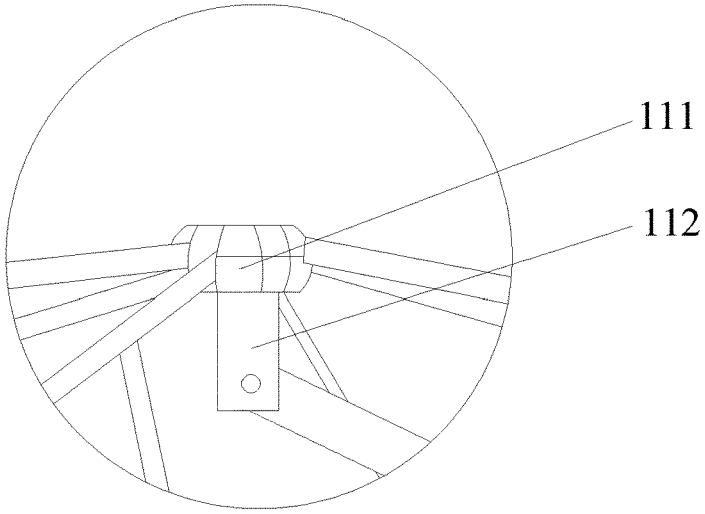
FIG. 4 is an assembled structural diagram of an upper umbrella disc of the invention.
Figure 5:
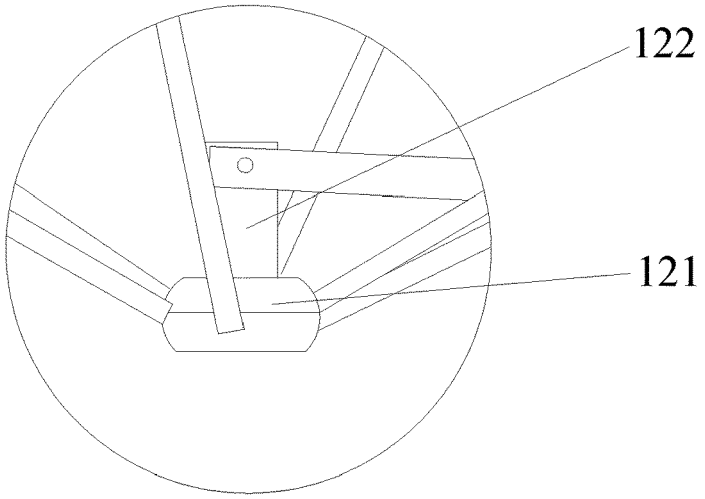
FIG. 5 is an assembled structural diagram of a lower umbrella disc of the invention.
Figure 6:
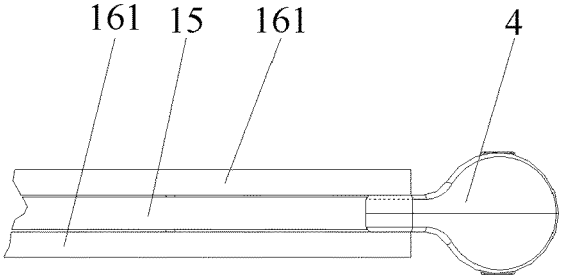
FIG. 6 is a cooperative assembly diagram of a first oblique rod, a second oblique rod and a mounting base of the invention.
Figure 7:
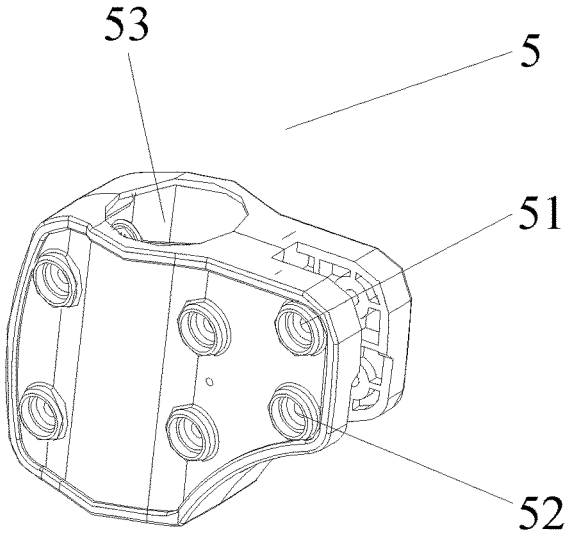
FIG. 7 is a structural diagram of a slide sleeve of the invention.
Figure 8:
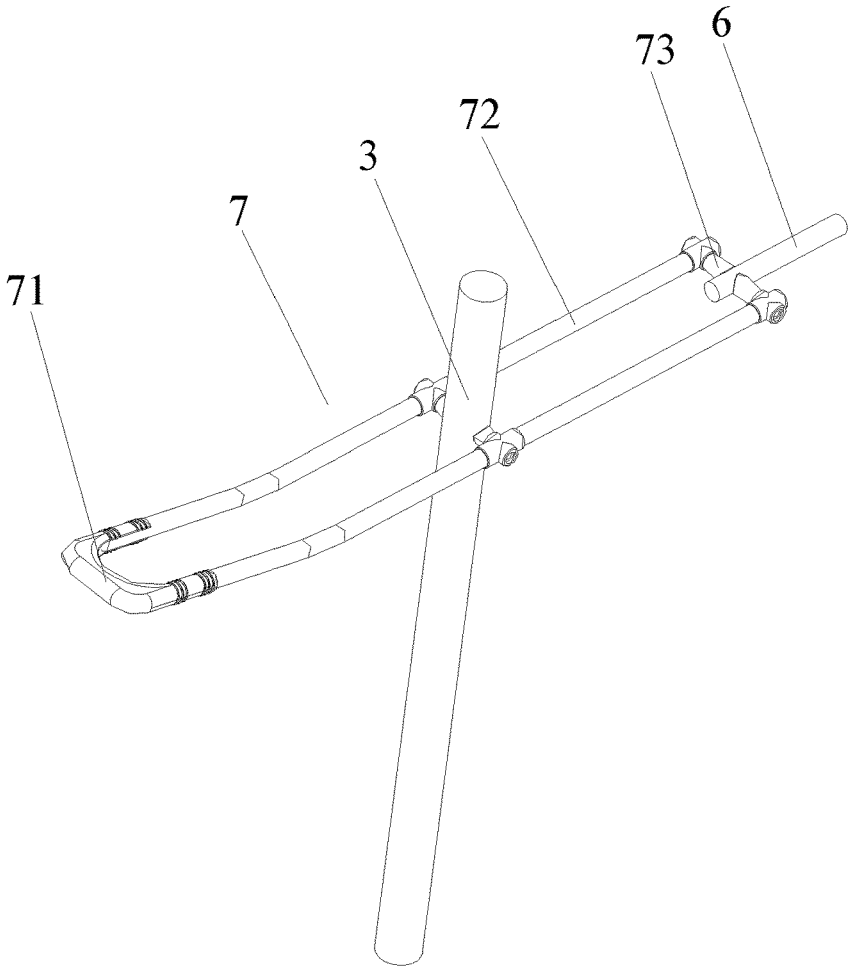
FIG. 8 is an assembled structural diagram of a folding-unfolding handle assembly of the invention.

As shown in FIG. 1 to FIG. 8, the invention provides an outdoor umbrella capable of being folded and unfolded by pressing. The outdoor umbrella comprises an umbrella post 3, an umbrella cover assembly and a folding-unfolding device. The umbrella cover assembly comprises an umbrella rib assembly 1 and an umbrella fabric 2 covering the umbrella rib assembly 1. The umbrella rib assembly 1 comprises a plurality of long umbrella ribs 13, a plurality of short umbrella ribs 14, a first oblique rod 15, a second oblique rod 16, an upper umbrella disc 11 and a lower umbrella disc 12. The upper umbrella disc 11 comprises a long umbrella rib hinge part 111 and an upper hinge part 112. The lower umbrella disc 12 comprises a short umbrella rib hinge part 121 which is shorter than the long umbrella rib hinge part 111, and a lower hinge part 122. The plurality of long umbrella ribs 13 are hinged to the long umbrella rib hinge part 111, the plurality of short umbrella ribs 14 are hinged to the short umbrella rib hinge part 121. The long umbrella ribs 13 are longer than the short umbrella ribs 14. An end of each of the plurality of short umbrella ribs 14 is hinged to one of the long umbrella ribs 13. One end of the first oblique rod 15 is hinged and matched with the upper hinge part 112, and one end of the second oblique rod 16 is hinged and matched with the lower hinge part 122.

Preferably, the upper hinge part 112 is integrally connected and fixed to the long umbrella rib hinge part 111 as one piece, and the lower hinge part 122 is integrally connected and fixed to the short umbrella rib hinge part 121 as one piece. Preferably, the upper hinge part 112 is typically divided into two portions, and the long umbrella rib hinge part 111 is integrally formed on a lower portion of the upper hinge part 112 by injection molding. The lower hinge part 122 is typically divided into two portions, and the short umbrella rib hinge part 121 is integrally formed on an upper portion of the lower hinge part 122 by injection molding. Or, the upper umbrella disc 11 and the lower umbrella disc 12 are integrally formed by injection molding, respectively. The structure of the upper umbrella disc 11 and the structure of the lower umbrella disc 12 are optimized to facilitate the assembly of the outdoor umbrella.

Preferably, the folding-unfolding device comprises a slide sleeve 5 which vertically slidable along the umbrella post, a folding-unfolding handle assembly 7 for folding or unfolding, and a pull rod 6 hinged between the slide sleeve 5 and the folding-unfolding handle assembly 7. The pull rod 6 is located on an inner side of the umbrella post 3, namely the side where an umbrella cover is located. The first oblique rod 15 and the second oblique rod 16 which are hinged and matched with each other are disposed on the umbrella rib assembly 1. Another end of the first oblique rod 15 is hinged to the slide sleeve 5, another end of the second oblique rod 16 is hinged and matched with the umbrella post 3, a middle portion of the folding-unfolding handle assembly 7 is hinged and matched with the umbrella post 3, and the folding-unfolding handle assembly 7 cooperates with a lever to vertically stretch the pull rod 6 and drives the slide sleeve 5 to vertically slide along the umbrella post 3, so that the umbrella cover assembly can be folded or unfolded.

Furthermore, the second oblique rod 16 comprises two oblique rod bodies 161 which are arranged symmetrically and are spaced apart from each other, and the first oblique rod 15 penetrates between the two oblique rod bodies 161 and is hinged and matched with the two oblique rod bodies 161. Generally, the first oblique rod 15 and the second oblique rod 16 are arranged in an X shape.

Furthermore, a mounting base 4 is disposed at a top end of the umbrella post 3, an end portion of each of the two oblique rod bodies 161 is hinged and matched with the mounting base 4, and the mounting base 4 is fixed to the top end of the umbrella post 3.

Furthermore, the slide sleeve 5 comprises a first hinge part 51 and a second hinge part 52. The first hinge part 51 is hinged and matched with an end portion of the first oblique rod 15, and the second hinge part 52 is hinged and matched with an end portion of the pull rod 6.

Furthermore, the slide sleeve 5 is sleeved on the umbrella post 3, and a sliding cavity 53 in sliding fit with the umbrella post 3 is formed in the slide sleeve 5.

Furthermore, the umbrella post 3 has a slide sleeve sliding section of an arc structure.

Furthermore, the folding-unfolding handle assembly 7 comprises two press rods 72 which are arranged symmetrically and are spaced apart from each other. The umbrella post 3 penetrates between the two press rods 72 and are hinged and matched with the two press rods 72. An end portion of each of the two press rods 72 is hinged and matched with the pull rod 6 through a connecting shaft 73. Two ends of the connecting shaft 73 are respectively hinged and matched with the two press rods 72, and the connecting shaft 73 is fixed and matched with the press rods 72. In another embodiment, the two ends of the connecting shaft 73 are fixed and matched with the press rods 72, and the pull rod 6 is hinged and matched with the connecting shaft 73.

Furthermore, a press handle 71 is connected to another end portion of each of the two press rods 72 to be used by users for operation. Preferably, the press handle 71 is located on an outer side of the umbrella post 3, namely the side opposite to the umbrella cover.

When the outdoor umbrella in a folded state is to be gradually unfolded, the press handle is located at the topmost, and a hinge point of the pull rod and the folding-unfolding handle assembly is located at the bottommost. A user pulls the press handle to move downwards until the middle portion of the folding-unfolding handle assembly is hinged and matched with the umbrella post. The hinge point of the pull rod and the folding-unfolding handle is moved upwards based on the lever principle to drive the pull rod to slide upwards along the slide sleeve sliding section of the umbrella post, and a hinge point of the first oblique rod hinged to the slide sleeve continuously moves upwards to be gradually close to a hinge point of the second oblique rod and the mounting base. Because a middle portion of the first oblique rod is hinged and matched with a middle portion of the second oblique rod, the upper umbrella disc and the lower umbrella disc are driven to gradually draw close to each other until the slide sleeve slides upwards to the maximum extent to completely unfold the umbrella cover. When the umbrella cover is completely unfolded, the upper umbrella disc and the lower umbrella disc are attached to or separated from each other, and at this moment, a distance between the upper umbrella disc and the lower umbrella disc is shortest. In this case, a limiting mechanism which typically comprises a limiting pin and a lock hole is configured, and the lock pin can be locked in the lock hole to limit the slide sleeve, so that the stability of the slide sleeve is improved, and the slide sleeve is prevented from sliding when the umbrella is in the unfolded state.

When the outdoor umbrella in the unfolded state is to be gradually folded, the press handle is generally located at the bottommost, and the hinge point of the pull rod and the folding-unfolding handle assembly is located at the topmost. The limiting pin is unlocked from the lock hole. The user pushes the press handle to move upwards, the hinge point of the pull rod and the folding-unfolding handle assembly is moved downwards through the cooperation of the middle portion of the folding-unfolding handle assembly and the umbrella post based on the lever principle, so as to drive the pull rod to slide downwards along the slide sleeve sliding section of the umbrella post, and the hinge point of the first oblique rod hinged to the slide sleeve continuously moves downwards to be gradually away from the hinge point of the second oblique rod and the mounting base. Because the middle portion of the first oblique rod is hinged and matched with the middle portion of the second oblique rod, the upper umbrella disc is driven to be gradually separated from the lower umbrella disc. Generally, when the press handle moves upwards over a horizontal plane, the slide sleeve automatically falls under the effect of gravity to fold the umbrella cover. The horizontal plane is a plane where the press handle is located at the same altitude as the hinge point of the pull rod and the folding-unfolding handle assembly.

According to the invention, through an optimized design, the slide sleeve can be made to slide along the umbrella post by pressing based on the level principle, so as to fold or unfold the umbrella cover, so that operation is easier; and the structure is simple, and the manufacturing cost is low.

It would be appreciated, based on common knowledge, that the invention can also be implemented through other embodiments without departing from the spirit or essential features of the invention. Therefore, from all aspects, the embodiments disclosed above are merely illustrative ones, and are not all possible ones of the invention. All transformations obtained within the scope of the invention or its equivalents should also be included in the invention.

What is claimed is:

1. An outdoor umbrella capable of being folded and unfolded by pressing, the outdoor umbrella comprising an umbrella post, an umbrella cover assembly and a folding-unfolding device, wherein the umbrella cover assembly comprises an umbrella rib assembly and an umbrella fabric covering the umbrella rib assembly, the folding-unfolding device comprises a slide sleeve which vertically slidable along the umbrella post, a folding-unfolding handle assembly for folding and unfolding, and a pull rod hinged between the slide sleeve and the folding-unfolding handle assembly, a first oblique rod and a second oblique rod matched and hinged with each other are disposed on the umbrella rib assembly, an end of the first oblique rod is hinged to the slide sleeve, an end of the second oblique rod is hinged and matched with the umbrella post, a middle portion of the folding-unfolding handle assembly is hinged and matched with the umbrella post, and the folding-unfolding handle assembly is able to vertically stretch the pull rod in cooperation with a lever and drives the slide sleeve to slide vertically to fold or unfold the umbrella cover assembly, wherein the slide sleeve comprises a first hinge part and a second hinge part, the first hinge part is hinged and matched with an end portion of the first oblique rod, and the second hinge part is hinged and matched with an end portion of the pull rod.

2. The outdoor umbrella capable of being folded and unfolded by pressing according to claim 1, wherein the umbrella rib assembly comprises an upper umbrella disc and a lower umbrella disc, the upper umbrella disc comprises a first umbrella rib hinge part and an upper hinge part, the lower umbrella disc comprises a second umbrella rib hinge part and a lower hinge part, and the first umbrella rib hinge part has a size longer than that of the second umbrella rib hinge part; a plurality of first umbrella ribs are hinged to the first umbrella rib hinge part, a plurality of second umbrella ribs are hinged to the second umbrella rib hinge part, and the first umbrella ribs are longer than the second umbrella ribs; an end of each of the plurality of second umbrella ribs is hinged to one of the first umbrella ribs, another end of the first oblique rod is hinged and matched with the upper hinge part, and another end of the second oblique rod is hinged and matched with the lower hinge part.

3. The outdoor umbrella capable of being folded and unfolded by pressing according to claim 2, wherein the upper hinge part is integrally connected and fixed to the first umbrella rib hinge part as one piece, and the lower hinge part is integrally connected and fixed to the second umbrella rib hinge part as one piece.

4. The outdoor umbrella capable of being folded and unfolded by pressing according to claim 2, wherein the second oblique rod comprises two oblique rod bodies which are arranged symmetrically and are spaced apart from each other, and the first oblique rod penetrates between the two oblique rod bodies and is hinged and matched with the two oblique rod bodies.

5. The outdoor umbrella capable of being folded and unfolded by pressing according to claim 4, wherein a mounting base is disposed at a top end of the umbrella post, an end portion of each of the two oblique rod bodies is hinged and matched with the mounting base, and the mounting base is fixed to the top end of the umbrella post.

6. The outdoor umbrella capable of being folded and unfolded by pressing according to claim 1, wherein the slide sleeve is disposed around the umbrella post, and a sliding cavity in sliding fit with the umbrella post is formed in the slide sleeve.

7. The outdoor umbrella capable of being folded and unfolded by pressing according to claim 1, wherein the umbrella post has a slide sleeve sliding section having an arc structure.

8. The outdoor umbrella capable of being folded and unfolded by pressing according to claim 1, wherein the folding-unfolding handle assembly comprises two press rods which are arranged symmetrically and are spaced apart from each other, the umbrella post penetrates between the two press rods and is hinged and matched with the two press rods, and an end portion of each of the two press rods is hinged and matched with the pull rod through a connecting shaft.

9. The outdoor umbrella capable of being folded and unfolded by pressing according to claim 8, wherein a press handle is connected to another end portion of each of the two press rods.

10. The outdoor umbrella capable of being folded and unfolded by pressing according to claim 1, wherein the second oblique rod comprises two oblique rod bodies which are arranged symmetrically and are spaced apart from each other, and the first oblique rod penetrates between the two oblique rod bodies and is hinged and matched with the two oblique rod bodies.

11. The outdoor umbrella capable of being folded and unfolded by pressing according to claim 1, wherein the slide sleeve is disposed around the umbrella post, and a sliding cavity in sliding fit with the umbrella post is formed in the slide sleeve.

* * * * *